United States Patent [19]

Dorow

[11] 4,428,291

[45] Jan. 31, 1984

[54] INKING UNIT FOR A PRINTING PRESS

[75] Inventor: Joachim Dorow, Neuhofen, Fed. Rep. of Germany

[73] Assignee: Albert-Frankenthal AG, Frankenthal, Fed. Rep. of Germany

[21] Appl. No.: 371,784

[22] Filed: Apr. 26, 1982

[30] Foreign Application Priority Data

May 2, 1981 [DE] Fed. Rep. of Germany ..... 3117341

[51] Int. Cl.[3] ..... B41F 31/06; B41F 31/26

[52] U.S. Cl. ..... 101/350

[58] Field of Search ..... 101/350, 351, 352, 349, 101/363, 364, 148, 206, 207, 208-210

[56] References Cited

U.S. PATENT DOCUMENTS

| | | | |
|---|---|---|---|
| 2,261,740 | 11/1941 | Makarius | 101/349 X |
| 2,276,525 | 3/1942 | Trotter | 101/350 |
| 2,530,282 | 11/1950 | Brude et al. | 101/350 |
| 2,986,088 | 5/1961 | Chase et al. | 101/350 |
| 3,026,796 | 3/1962 | Crawford | 101/157 |
| 3,135,197 | 6/1964 | Dutro et al. | 101/364 |
| 3,285,169 | 11/1966 | Hartwig | 101/350 X |
| 3,613,578 | 10/1971 | Heuri et al. | 101/350 |
| 3,688,694 | 9/1972 | Preuss | 101/350 |
| 4,186,661 | 2/1980 | Vieau | 101/350 X |
| 4,244,292 | 1/1981 | Williams et al. | 101/352 |
| 4,290,363 | 9/1981 | Köbler | 101/363 |

FOREIGN PATENT DOCUMENTS

| | | | |
|---|---|---|---|
| 639293 | 12/1936 | Fed. Rep. of Germany | 101/350 |
| 1292957 | 4/1969 | Fed. Rep. of Germany | 101/375 |

*Primary Examiner*—J. Reed Fisher

*Attorney, Agent, or Firm*—Allison C. Collard; Thomas M. Galgano

[57] ABSTRACT

For producing quality work on a printing machine using a hard printing plate and high viscosity printing ink taken up by a fountain roller running in an ink fountain and transported by the fountain roller to an ink drum running against at least one form roller for inking the plate, while nevertheless keeping the inking system design simple, the inking unit has a single form roller having a diameter equal to that of the working diameter of the plate and designed to be run at the same surface speed as the plate: the drum for inking the form roller has a screen on its outer face made up of ink takeup pockets separated by lands, the ink drum having a smaller diameter than the form roller and being turned by a driving system of the press. The outer face of the ink drum with the screen is stripped by a stripping unit, such as doctor plate, running on and clearing the lands between the ink takeup pocket. Furthermore the fountain roller is run with a speed different to that of the screened ink drum.

20 Claims, 5 Drawing Figures

FIG 4
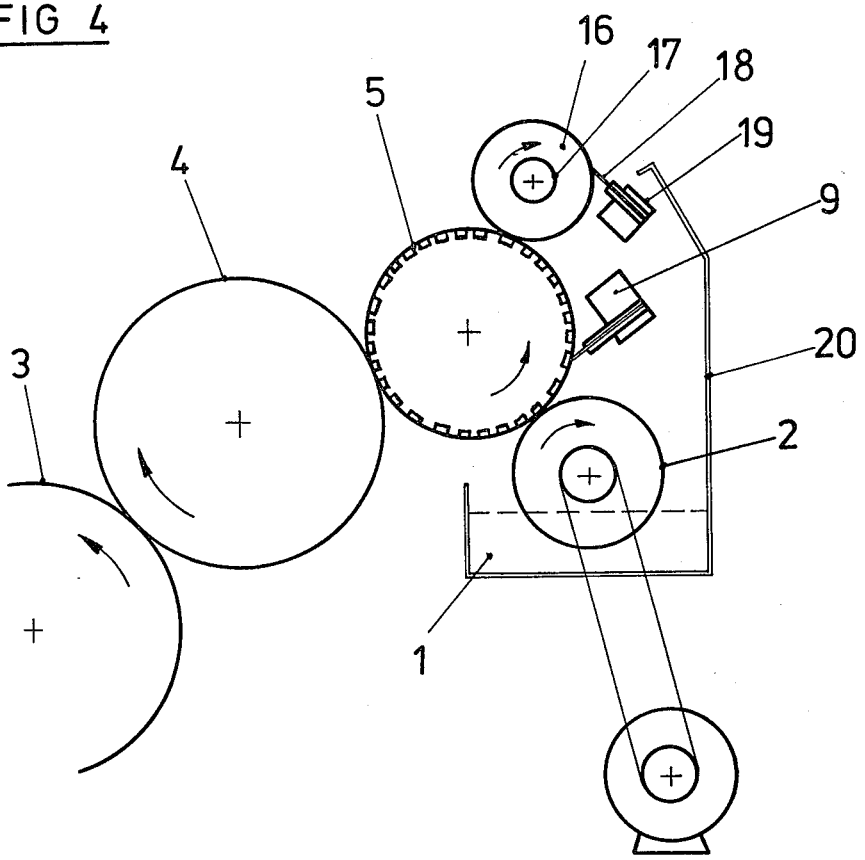
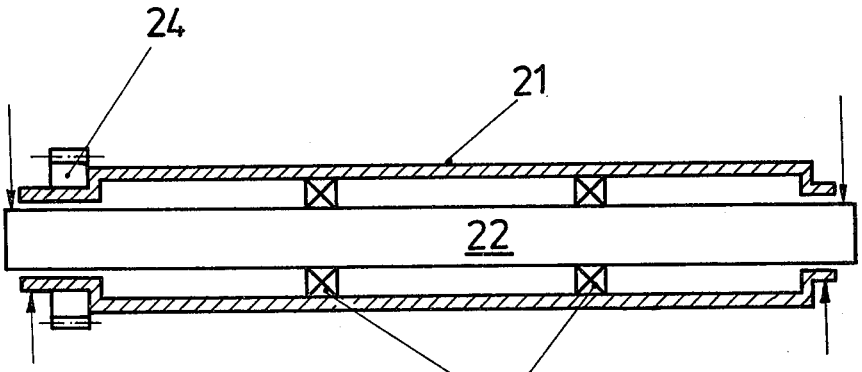
FIG 5

INKING UNIT FOR A PRINTING PRESS

BACKGROUND OF THE INVENTION

The present invention relates to an inking unit for printing presses using a hard printing image carrier and high-viscosity printing inks, and more specially offset printing presses, having a fountain roller in an ink fountain, a form roller for inking a printing image carrier fixed to a cylinder, the form roller running with the same surface speed as the printing image carrier, and an ink drum for forwarding ink from the fountain roller to the form roller, the ink drum having a different diameter, and more specially a smaller diameter, than the form roller and being turned at a different surface speed than the surface speed of the fountain roller.

In printing presses of this general design the inking unit has the main purpose of offering the form roller system an even, thin film for the printing image carrier or plate to take up. Under normal conditions of operation however this film is only taken up by the printing areas of the plate, that is to say not completely and a relief-like ink film is kept on the form roller. A further important function is for this reason that of levelling and evening off this relief-like film which would otherwise be responsible for "ghosting". In the case of such ghosting, the printing areas of the plate are no longer inked fully all over so that the ink density on the material printed is not great enough. On using high-viscosity printing inks, as for example offset printing inks, a roller system with a great number of rollers is generally used in order to get a thin ink film or coating with the desired thickness, the great number of small rollers further making certain that the printing plate is equally inked so that ghosting is not possible. Furthermore in prior art inking units of this sort adjustment of the ink rate of the breadth of the machine (along the axis) is possible using finger screws so that the amount of ink put on is matched with the amount of ink taken up by the form roller system. Such prior art inking units are not only very complex and take up much space, but furthermore may only be run by fully trained pressmen, and even so ghosting may still be possible. For this reason scavenger rollers have been used on the form rollers for evening out the thickness of the ink film, such a design however being very complex and, again, taking up space which is needed for other purposes.

For making the structure simpler and less complex, while cutting down the amount of space needed, "short inking units" have been designed, the inking unit of German Offenlegungsschrift specification No. 2,916,048 being representative of this branch of printing press development.

In this respect the desired thickness of ink film on the form roller is to be produced by a pressman-controlled pressure between the rollers acting together, by using different speeds of such rollers, that is to say causing one roller to be turned at a different or relative speed in relation to the other roller, and furthermore by a great number of ink storing or conditioning rollers used with the form roller and the ink drum. The ink film thickness is furthermore to be produced and controlled by an oscillating motion of the ink drum.

SUMMARY OF THE INVENTION

Taking this suggestion of the prior art as a starting point, one purpose of the present invention is that of not only taking care of the shortcomings of known systems, while nevertheless still producing their useful effects, but furthermore making such further development of an inking unit of the sort noted with simple, and for this reason, low-price systems that the outcome is not only a simple design of inking unit taking up little space and having only a small number of working parts, but furthermore is readily run without any trouble conditions on operation. At the same time there is to be a smooth, troublefree forwarding of ink to the form rollers, the ink being evenly offered to the form roller part of the inking unit without any trouble being caused by events such as changes in temperature, eccentricity, dirt in the ink and the like so that the printing image carrier is evenly inked without any trouble and ghosting is put an end to in all cases, while at the same time there is a low wear rate and smooth operation so that the inking unit has a long working life.

For effecting such purposes the present invention is different to the prior art inasfar as the form roller has a diameter equal to the working diameter of the printed image carrier and in that the ink drum used with the form roller is turned at the same surface speed as it, the ink drum having a screened outer face with ink takeup pockets and lands therebetween, such screen being only a little finer than the screen of the printing image carrier which is to be inked, the ink drum having a doctor system running on and taking ink from the lands between the pockets.

The positions at which form roller and ink drum on the one hand and the ink drum and the fountain roller are run on each other are only for transfer of ink, that is to say without any metering or ink rate control. The force with which the rollers are pressed together and the breadth of the gap therebetween may for this reason undergo adjustment for decreasing wear as far as possible, this being a useful effect. At the same time, because the ink rate is not controlled by changing the gap, operation of the press is better. The design steps taken as part of the invention make it possible for this reason for the system to be simply run and used so that less highly trained pressmen will be needed. The thin ink film needed on the form roller is in this respect produced by specially well thought-out combinations of design points which are important in this respect. The structure needed for producing the design is in this respect generally speaking simple. Nevertheless very troublefree operation is made possible, even if running conditions are changed, as for example if there is a change in temperature, in the press speed and the amount of dirt in the press. When the press is in operation a thick ink film is taken up by the fountain roller and placed on the screened roller, from which however unnecessary ink is stripped so that ink takeup pockets, formed by little cups, in the screened roller only are kept full of ink, the rest of the ink being stripped off. For this reason the amount of ink forwarded to the form roller is completely dependent on and controlled by the volume of the ink takeup pockets. There is then the useful effect that the amount of ink offered to the form roller will be the same all the time. The pattern of ink which is forced by the screened roller onto the form roller will, as a further useful effect, be responsible for an even ink distribution. The screened form, as part of the invention, of the ink drum gives the useful effect of an even and dense enough supply of ink. The rolling out of the high viscosity printing ink as a thin film is no longer needed, this being a further useful effect of the invention inasfar as the design of the inking unit is simple and takes up little space. Any eccentricity is not in this case able to be responsible for any undesired effects. The screened roller is turned round a number of times each time the form roller is turned round so that, even although the surface speed is the same (this giving a low wear rate) the film is evened out and an even, regular supply and film of ink is made certain of. Because the form roller has in the invention the same diameter as the plate cylinder, ink will be taken from any given point thereof at the same point on the printing plate on every turn thereof. For this reason any relief-like form of the ink film hardly has any undesired effect, while at the same time it is possible to make certain that there is ever-increasing building up of ink on non-printing areas of the plate because the part of the screened roller acting thereon is stripped. This puts a complete end to any "ghosting" in all cases, while at the same time making it possible for the form roller to have a soft surface layer to make certain of smooth running with little wear. The fountain roller and the screened roller are only to be so placed in relation to each other that there is a handing over ink from one to the other and no carefully controlled forcing of the one roller against the other is necessary so that, even if the fountain roller and the screened drum are run with different surface speeds one may be certain of smooth, low-wear operation. At the same time difference in surface speeds between the screened drum with a doctor and the fountain roller is responsible for the ink being taken up into the ink takeup pockets in the screened drum, the pockets being regularly filled with ink. A further useful effect is produced inasfar as the form roller does not have to be powered so that even if there is a small amount of abrasion there will be no slip and coarse diameter tolerances may be used. The useful effect produced with the invention is seen, for these reasons, on the one hand in the simple design, simpler and more natural operation from the pressman's point of view and smooth, troublefree operation.

As a further useful development of the general idea of the present invention the fountain roller and the screened drum with the doctor may be turned so that at the point where they are nearest together their touching surfaces are moved in opposite directions, this making it possible for the stripping doctor systems used with the screened drum and possibly with the fountain roller to be readily got at by the pressman, the direction of turning of the press being unimportant in this respect.

Because of the high ink viscosity it is possible to have a gap between the fountain roller and the screened drum with the doctor so that the faces of the two rollers are not touching, this being a useful development for cutting down wear which might otherwise be caused by the difference in speed between the outer faces of the fountain roller and the screened drum with the doctor. A useful effect is produced if adjustment of this gap is possible so that, even when wear takes place as times goes by, conditions in this part of the press may be kept the same. For adjustment of the rate at which ink is forwarded from the fountain roller to the drum all that is needed is a simple adjustment of the gap between the fountain roller and the screened drum. Furthermore, however, the fountain roller may have a metering system, which is best designed in the form of an adjustable ink rate controlling doctor blade. Because of such a first step of rate control there is the useful effect that the stripping or doctor system of the screened drum will have less work to do.

For stopping ink running up at the end of the fountain roller it is possible for such end faces to have doctor blades as well.

The stripping system of the screened drum may take the form, as part of a preferred working example of the invention, of a doctor blade running on the screened drum and, more specially, oscillated backwards and forwards. This further development of the invention is responsible for a specially simple but nevertheless exact function.

As part of a further useful development of the invention the fineness of the screen of the screened drum has only two times as many rulings for each unit of length as the screen of the printing plate, that is to say the screen of the screened drum is generally speaking coarse, such a screen, made up of the pockets and lands therebetween giving a generally high rate of transport of the high viscosity printing ink to be used in the present case so that, as a useful effect, full, dense shades are produced on the material printed. Although in flexographic printing screened rollers are used as well, the screen thereof is finer than the screens of the printing image carrier in such printing, the image carrier in this case being soft. In point of fact, such screened rollers for use in flexographic printing have to be at least three times and in many cases four times finer than the printing image carrier used therewith for stopping any moiree effects. On printing with high viscosity printing inks on the other hand such a relation between the screen on the roller and the screen of the printing plate would not give in any way the desired rate of ink transport.

As a further development of the general idea of the present invention the screened drum may have zone rollers rested against it, each such roller stretching along part of the length of the drum and each more specially having a doctor blade in the form of a stripping system. With this system it is possible for ink to be stripped from those parts of the screened drum which are over non-printing areas of the plate for stopping forming of an emulsion of the ink with the dampening fluid.

Further useful developments and forms of the general system of the present invention will be seen from the account now to be given of some working examples using the figures, and in connection with the dependent claims.

BRIEF DESCRIPTION OF THE DRAWINGS

FIG. 4 is a side view of a further working example of the invention in which the screened drum has zone rollers.

FIG. 5 is a view of one possible form for the bearing system of the fountain roller, the screened drum or the form roller.

DETAILED DESCRIPTION OF THE ILLUSTRATED AND PREFERRED EMBODIMENTS

Figure 1:
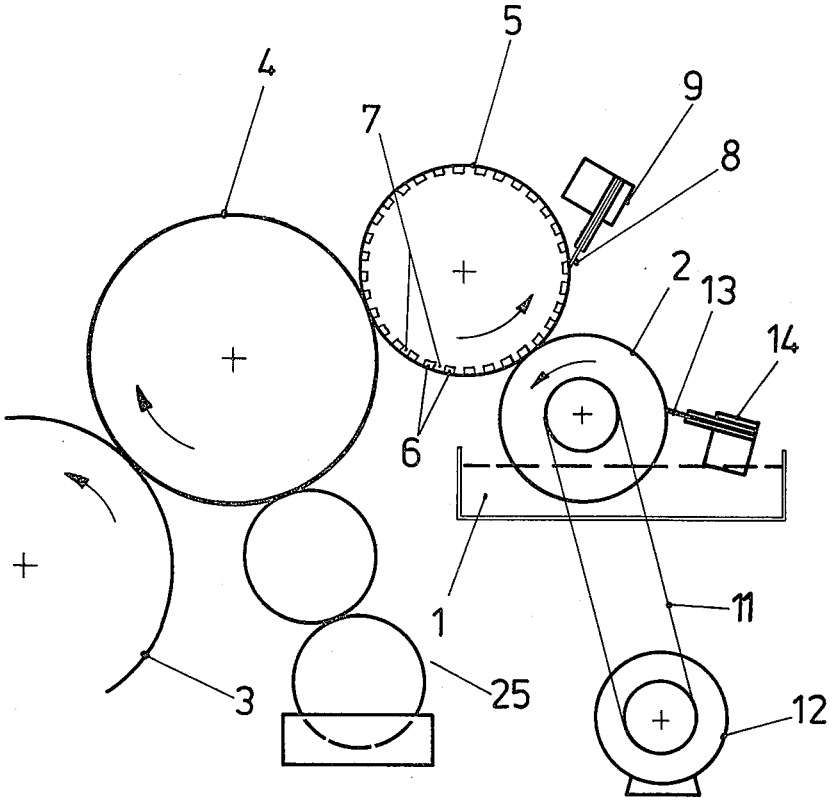
FIG. 1 is a side view of an inking unit of the present invention presented diagrammatically.

The inking unit to be seen in FIG. 1 is made up of a fountain roller 2 running in an ink fountain 1, a form roller 4 running on a printing plate (not marked in the figure) fixed on a plate cylinder 3, and lastly a screened roller 5 for forwarding the ink from the fountain roller 2 to the form roller 4. Form roller 4 has a soft outer face, more specially a rubber face. The roller may for example be made up of a piece of printer's blanket fixed adhesively on a steel core so that the edge of the blanket material parallel to the axis are lined up with the well or groove in which the system for fixing the plate is present in plate cylinder 3. Screened drum 5 is in the form of a steel roller whose outer face has ink takeup pockets 6 (to be seen on a very much larger scale in FIG. 1) and lands 7 between the pockets. Fountain roller 2 may as well have a rubber outer face.

The screen, that is to say the pattern of ink takeup pockets 6 and lands 7, of screened drum 5 may be formed by grooving or knurling the outer face of steel screened roller. 5. The doctor blade 8 of a stripper or doctor blade unit 9 is rested against the screened drum 5 so that ink on the drum which is not within the pockets 6, and not needed for filling them, is stripped off. The system is best so designed as to make possible adjustment of the force with which the working edge of the doctor blade 8 is pressed against the drum and the angle thereof so that on the one hand doctor blade wear is limited, although it may not be stopped completely, while at the same time there is nevertheless a full stripping effect on the outer face of the lands 7 placed round the ink takeup pockets 6. In the present working example, the doctor or stripping unit 9 is oscillated in the axial direction so that no doctor streaks are produced. In place of the doctor blade unit 9 it would furthermore be possible to have another form of stripping unit, for example the fountain roller 2 against which the screened drum 5 is run. In the case of such a design the fountain roller 2 will simply be forced against the screened drum 5 so that unnecessary or excess ink will be squeezed off, an effect which is more specially supported if at the gap between the rollers the same are turned in opposite directions. The stripped outer face of the screened drum 5 comes up against the form roller 4 offering it ink at a generally equal rate, such rate being only dependent on, and controlled by, the degree to which the ink takeup pockets 6 (having an even distribution over the outer face of screened roller 5) are able to take up the ink. The form roller 4 running on the screened drum 5 does in fact have an even screen pattern printed on it along its complete length in, one might in fact may, a rotogravure process. The design is best so made that the screened drum 5 is forced against the form roller 4, adjustment of the force being possible for the purpose of taking care of any eccentricity while nevertheless making certain of troublefree inking. The same is furthermore true for the form roller 4, that is to say adjustment thereof with respect to the plate cylinder 3 with the plate it will be possible as well. For producing such adjustment the screened drum 5 and the form roller 4 may be supported in a known way in adjustable eccentric sleeves, this making possible at the same time adjustment of the gap between the screened drum 5 and a fountain roller 2.

The diameter of the form roller 4 is the same as that of the plate pulled tight at its ends and so fixed on the plate cylinder 3. The form roller 4 is turned so as to have the same surrace speed and, at the point at which it is touched by the plate on the plate cylinder 3, the same direction of turning as the plate cylinder. As has become clear on testing, such an adjustment of the parts certainly puts an end to any chance of ghosting. The screened drum 5, running on the form roller 4, has a smaller diameter than the form roller 4 so that for each turn of the form roller the drum will be turned more than once while running on the form roller, this giving a useful effect with respect to even and equal inking of the form roller 4. The screen, that is to say the pattern of ink takeup pockets 6 and lands limiting the same, on the screened drum 5 will be produced so as to get the best depth of pocket and fineness of screen pattern. The degree to which the pockets 6 take up ink is so designed that full, dense shades may be produced on the material printed. The fineness of the screen is such that even high viscosity printing inks may be used without any trouble. As has been seen from tests, very good effects may be produced if the screen on the screened drum 5 has only two times as many rulings or lines for giving units of length as the screen of the printing plate used therewith. The screened drum 5 is for this reason very much different to screened rollers as normally used for flexographic printing, such rollers having much finer screens. In the present case the offset printing plate is to have screen fineness of 50 rulings/cm, the screened drum used therewith having 100 rulings/cm, a form of screen which may be used on printing with other offset plate screen finenesses up to 80 rulings/cm. The screened drum 5 is so turned by the press that its direction of motion where it is touched by the form roller 4 is the same as the direction of motion of the surface of the roller 4. The driving system for the form roller 4 and of the screened drum 5 may best be by way of spur gear wheels turned by a driving wheel on the plate cylinder 3. The surface speed of the screened drum 5 may be the same as the surface speed of the form roller 4 so that there is no slip therebetween and for this reason a low wear rate. However, be this as it may, it would furthermore be possible for the screened drum 5 to be turned by the press so as to have surface speed different to that of the form roller 4 for metering the rate at which ink is forwarded to the form roller, giving a good distribution of ink thereon and for changing the ink film density to be in line with the needs of different jobs.

Figure 2:
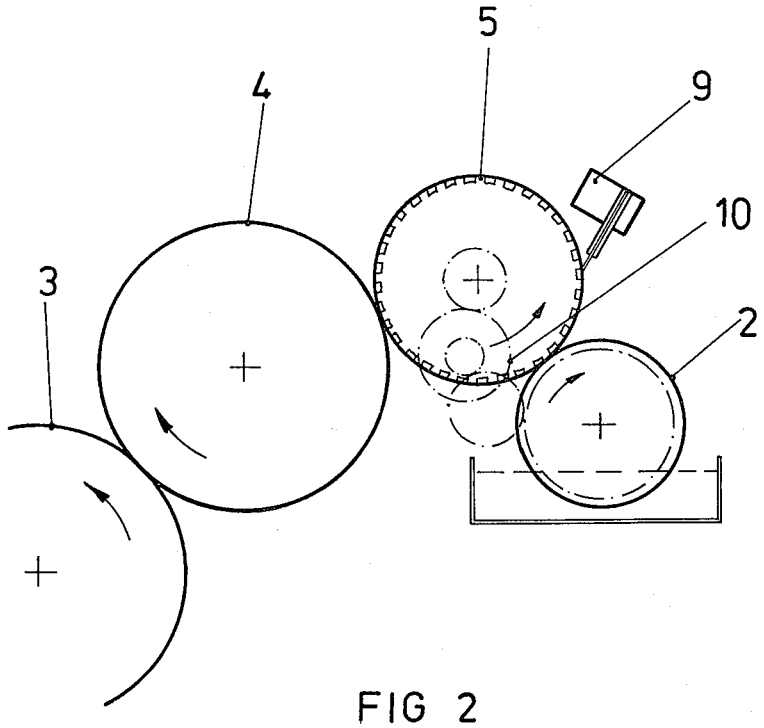
FIG. 2 is a view of a further working example of an inking unit of the present invention, the view being from the side, on the same lines as in FIG. 1.

Fountain roller 2 is to be run at a very much lower speed than screened drum 5 to make certain that even on printing with high viscosity or viscuous inks in the fountain the ink becomes leveled out without any chance of fountain roller 2 simply making a pocket in the ink and running itself free so that no ink is taken up thereby. The driving force for the fountain roller 2 may, as may be seen from FIG. 2, be taken from the gearing driving the screened drum 5, using, as a simple design, a group 10 of spur gear wheels. In the working example of FIG. 1, the fountain roller 2 is turned by way of a driving chain 11 from a separate geared motor 12. Geared motor 12 may if desired have a change speed system so that the speed of fountain roller 2 may be changed. Fountain roller 2 may be turned in such a direction that at the gap between it and the screened drum 5, or nip at this position, it is run in the same direction as screened drum 5, this being marked by arrows in FIG. 2, or it may be run in the opposite direction, as is marked in FIG. 1. In the two cases there will, at the nip where the rollers are touching, be a building up of a rope of ink, this making quite certain that the ink takeup pockets 6 are fully topped up with ink. Fountain roller 2 may be turned bodily towards and away from the screened drum 5, this being made simpler by the use of a separate driving system (see FIG. 1). Because of this design the gap between the fountain roller 2 and the screened drum 5 may undergo adjustment to make small changes in size if there should be changes in the diameters of the roller and the drum. At the same time it is possible furthermore for the screened drum 5 to be stripped or "doctored" with the help of the fountain roller 2 so that the doctor blade unit 9 will no longer be needed, this fact having been gone into earlier. In this case as well a useful effect is produced if the directions of turning are opposite, as in FIG. 1. In the working example of FIG. 1 the thickness of the ink film taken up by the fountain roller 2 from ink fountain 1 may be changed by way of a stripping edge working on the outer face of the fountain roller 2 so that a first stage of ink rate control will be produced. To this end in the working example of FIG. 1 use is made of a rate controlling or metering unit 14 whose angle with respect to fountain roller 2, and a force with which it is pushed theretowards may be changed by adjustment as desired, unit 14 having a doctor blade 13. The doctor blade 8 of the stripping unit 9 and the further doctor blade 13 of the rate controlling unit 14 are so placed over the ink fountain 1 that the ink stripped or doctored from the drum and the roller will be able to make its way straight down into ink fountain 1 or indirectly. In the working example of FIG. 1 the stripping unit 9 is placed over the part of the outer face of fountain roller 2 which is moving towards the screened drum 50 so that the stripped-off ink will be used for building up the rope of ink at the opposite nip with a useful effect. If the fountain roller 2 and the screened drum 5 are turned in opposite directions the rate controlling unit 14 and the stripping unit 9 may be placed so that they are easily got at by the pressman, without the direction of turning of the plate cylinder being important in this respect.

Figure 3:
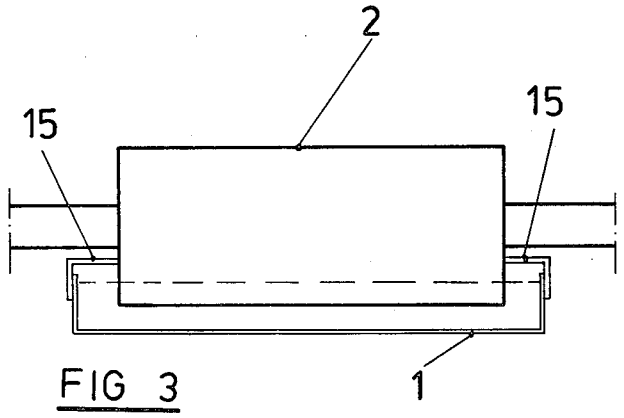
FIG. 3 is a side view (that is to say as seen from the end of the press) of a fountain roller running in an ink fountain.

In many cases there is the danger of ink making its way upwards over the ends of fountain roller 2, something which may be stopped (see FIG. 3) by stripping knives 15 running against the end faces of the fountain roller 2 and which in the present case are simply fixed on the side fountain endpieces.

In the working example of FIG. 4 zone rollers 16 are used running on certain zones of the outer face of screened drum 5, the length of each such zone roller 16 being equal to the breadth of non-printing areas or zones free of ink. These zone rollers 16 have the function of clearing ink from the screen drum 5, something which may be useful in many cases for stopping the ink forming an emulsion with the dampening fluid on the printing plate. The zone rollers may be powered or simply turned by friction. If they are power-turned the useful effect may then be produced by having a driving shaft 17 stretching over the full breadth of the press and joined by a group of gear wheels with the spur wheel on the screened drum 4, the zone rollers 16 simply being slipped onto the shaft 17 and kept in position by spacers. The ink taken up by the zone rollers 16 is stripped therefrom by a stripping unit 19 having a doctor blade 18, the ink then making its way back into the fountain 1. In the working example in question the stripping unit 19 is so placed that the ink stripped thereby makes its way more or less automatically back into the ink fountain 1. The fountain endpiece next to this position has an upwardly stretching part forming a guide 20 to a point over the stripping unit 19, the ink then stripped by unit 19 then running for this reason along guide 20 back into the ink fountain 1.

Sagging of the fountain roller 2, of the form roller 4 or the screened drum 5 may be stopped by balancing out such sagging and to this end such a roller, as may best be seen from FIG. 5, is made up of a pipe-like outer casing 21 and a shaft running therethrough from end to end with a radial space therebetween, the ends of the shaft running out at the ends of the casing 21. The radial ring-like space between the casing 21 and the shaft 22 is bridged over by at least one, in the present case two, self-aligning bearings 23 which is or are symmetrical with respect to the middle of the shaft, this being to make certain that the casing 21 and the shaft 22 may have different amounts of sag separately from each other so that the sagging effect is balanced. Casing 21 may be turningly supported at its ends by further self-aligning bearings. In this case the ends of the shaft 22 are so acted on by adjustment system that the sag produced in the shaft 22 overcomes the sag of the casing 21 in effect. It is however furthermore possible for the casing 21 to be bearinged on the shaft 22, the shaft 22 having its ends placed in adjustment units (not marked in the figure). The adjustment force, working on the shaft 22, makes it possible for the casing to be so bent or sagged its line of bending is truly lined up with the line of bending of the roller used therewith so that the two parts are fully and regularly rested against each other. Shaft 22 may be so supported that it may not be turned. In this case the casing 21 would then be turned by way of a spur wheel directly, such wheel being marked 24 in FIG. 5. It would however furthermore be possible for the shaft 22 to be power-turned and to be turningly bearinged. The support bearings might in this case be simply in the form of spring rings or circlips. For making certain of even distribution of the heat produced at supporting bearings 23 on the full length of the casings 21 the ring-like space between the casing and the shaft may simply be partly filled with oil.

The inking unit to be seen in the figures is designed for using in offset printing together with a dampening unit marked 25 in FIG. 1. This dampening unit 25 is in this case designed for running on the form roller 4, that is to say with the dampening form roller running on the ink form roller 4. For stopping scrumming of the plate, the dampening fluid is put on at a point to the back of the nip where the screen drum 5 and the form roller 4 are touching, in other words the dampening unit 25 is placed after this nip in the direction of turning of form roller 4.

What is claimed is:

1. In an inking unit for a printing press designed for printing from a hard printing plate as a printing image carrier having a printing image screen thereon and mounted on a printing plate cylinder, said inking unit using a high viscosity ink and comprising:

(a) a fountain roller;

(b) a form roller for inking said printing plate running against and at the same surface speed as said plate cylinder and having a diameter equal to the working diameter of said plate cylinder;

(c) an ink drum roller for forwarding ink from said fountain roller to said form roller having a different diameter than said form roller, wherein said ink drum roller is turned at the same surface speed as said form roller and at a different surface speed than said fountain roller, said ink drum roller having a screen pattern of ink takeup pockets separated by lands on an outer surface thereof, said pattern being a little finer than the printing image screen on said printing plate; and (d) a stripping means for clearing ink from said lands of said screen pattern on the outer surface of said ink drum roller.

2. The inking unit as claimed in claim 1 further having a driving means for turning said fountain roller and said ink drum roller in opposite directions at a nip therebetween.

3. The inking unit as claimed in claim 1 having a further driving means for turning the fountain roller at a low speed.

4. The inking unit as claimed in claim 3 wherein said further driving means is designed for turning said fountain roller at a lower surface speed than the ink drum roller.

5. The inking unit as claimed in claim 1 wherein said fountain roller and said ink drum roller are placed with a gap therebetween.

6. The inking unit as claimed in claim 5 having an adjustment means for adjustment of said gap.

7. The inking unit as claimed in claim 1 having an ink rate controlling means for controlling the rate of ink input to said fountain roller.

8. The inking unit as claimed in claim 7 in which said rate controlling means is adjustable.

9. The inking unit as claimed in claim 1 having stripper blades for stripping ink from ends of said fountain roller.

10. The inking unit as claimed in claim 1 wherein the screen pattern on said ink drum roller has two times as many rulings for each unit length than the printing image screen of the printing plate.

11. The inking unit as claimed in claim 1 wherein said ink drum roller has a knurled outer face.

12. The inking unit as claimed in claim 1 wherein said stripping means for said ink drum roller is in the form of a doctor blade.

13. The inking unit as claimed in claim 12 wherein said doctor blade may be oscillated in the direction of its length.

14. The inking unit as claimed in claim 1 having zone rollers placed generally end to end along the length of said ink drum roller for scavenging from said drum, and a stripping means for stripping ink from said zone rollers.

15. The inking unit as claimed in claim 14 wherein said stripping means has a doctor blade.

16. The inking unit as claimed in claim 1 having a means for forcing the ink drum roller against the form roller.

17. The inking unit as claimed in claim 16 having a means for adjustment of the ink drum roller in relation to the fountain roller and the form roller.

18. The inking unit as claimed in claim 1 having a means for adjustment of the form roller in relation to the printing plate.

19. The inking unit as claimed in claim 1, 2 or 3 wherein at least one of said fountain roller, form roller and ink drum roller is made up of a pipe-like outer casing having a shaft running therethrough for supporting said casing on at least one bearing, the ends of said shaft running out of said casing at the ends thereof and being taken up in adjustment parts for balancing any sag of said at least one roller.

20. The inking unit as claimed in claim 1, 2 or 3 wherein said ink drum roller is smaller in diameter than said form roller.

* * * * *